US006626963B2

(12) United States Patent
Capt et al.

(10) Patent No.: US 6,626,963 B2
(45) Date of Patent: Sep. 30, 2003

(54) PROCESS FOR RESTORING THE APPEARANCE OF PIGMENTED OR DYED PARA-ARAMID FABRIC

(75) Inventors: Andre Capt, Gland (CH); Hamid Moayed Ghorashi, Midlothian, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/960,102

(22) Filed: Sep. 21, 2001

(65) Prior Publication Data

US 2003/0056305 A1 Mar. 27, 2003

(51) Int. Cl.[7] ..... D06P 5/02; D06P 3/04
(52) U.S. Cl. ..... 8/441; 8/925
(58) Field of Search ..... 8/441, 925

(56) References Cited

U.S. PATENT DOCUMENTS

| | | | |
|---|---|---|---|
| 2,424,778 A | | 7/1947 | Tainsh |
| 3,069,223 A | * | 12/1962 | Moroschan |
| 3,767,756 A | | 10/1973 | Blades |
| 3,869,429 A | | 3/1975 | Blades |
| 4,144,023 A | | 3/1979 | Provost |
| 4,308,374 A | | 12/1981 | Vollbracht et al. |
| 4,698,414 A | | 10/1987 | Bair |
| 4,985,046 A | | 1/1991 | Hartzler |
| 5,232,461 A | | 8/1993 | Ghorashi |
| 5,660,779 A | | 8/1997 | Bowen et al. |

* cited by examiner

*Primary Examiner*—Margaret Einsmann

(57) ABSTRACT

The visual appearance of pigmented or dyed para-aramid fabric generally present in an article of clothing is restored by contacting the fabric with an aqueous dye solution or dispersion to dye abraded fibrils attached to the aramid filaments in the fabric. Use of a conventional washing machine is suitable in the fabric contact with the dye.

11 Claims, No Drawings

PROCESS FOR RESTORING THE APPEARANCE OF PIGMENTED OR DYED PARA-ARAMID FABRIC

FIELD OF INVENTION

The present invention relates to a process for improving the appearance of a fabric, particularly made into an article of clothing, which comprises a pigmented or dyed aramid yarn wherein a portion of the yarn contains para-aramid fiber with abraded fibrils. The process involves contacting the yarn with an aqueous dye solution or dye dispersion wherein the process is particularly adaptable using a conventional washing machine.

BACKGROUND OF THE INVENTION

An important use of aramid yarn is in the manufacture of articles of clothing and particularly articles of clothing employed in hazardous high temperature environments, such as the outer garments used by fire fighters Typically, the articles of clothing are made from a combination of para-aramid yarns such as poly (p-phenylene terephthalamide) referred to herein as PPD-T and other yarns such as poly(meta-phenylene isophthalamide) referred to herein as MPD-I.

However, difficulties and disadvantages arise with the use of para-aramid yarn from an appearance standpoint.

Para-aramid fiber has a highly ordered fibrillar structure with a propensity for fibrillation attributable to the lack of lateral forces between macromolecules. As the para-aramid content of a fabric increases above 5 weight percent, the extent of potential fibrillation of the para-aramid fibers also increases and the actual abraded fibrils can become more noticeable and objectionable. With the wear, abrasion, and laundering that occurs as the fabric article is used over time, dyed and pigmented fabrics lose their new look and aesthetic appeal.

Para-aramid fibers in general and in particular, poly (paraphenylene terephthalamide) (PPD-T) fibers, have molecular features of high crystallinity, a stiff molecular chain and high interchain bonding forces resulting in high tensile strength and high modulus. However, these molecular features which provide such outstanding physical properties also result in the para-aramid fibers being quite difficult to dye. This attribute of para-aramid fiber is generally discussed in U.S. Pat. No. 4,144,023 to Provost, U.S. Pat. No. 4,985,046 to Hartzler, and U.S. Pat. No. 5,232,461 to Ghorashi, wherein various dyeing processes are disclosed.

U.S. Pat. No. 4,144,023 discloses an improved dyeing process wherein wetted aromatic polyamide fibers are crimped and maintained moist before dyeing. U.S. Pat. No 4,985,046 discloses disadvantages of "spun-in" and "structure prop" methods of dyeing poly(paraphenylene terephthalamide) fibers and discloses a process wherein specially prepared fibers (acid treated or never dried) are contacted with an aqueous solution of a dye promoting species. U.S. Pat. No. 5,232,461 discloses dyeing poly (paraphenylene terephthalamide) fibers by heating them under high pressure.

None of the U.S. Patents discussed above relate to the problem of restoring the appearance of fabrics which contain fibrillated aromatic polyamide fibers.

Treatment of a used or worn fabric to adjust the overall color of the fabric by totally dyeing the yarns in the fabric with blueing agents is described in U.S. Pat. No. 2,424,778 to Tainsh. Blueing agents are described as generally being blue colors, pigments or dyes having generally a slight reddish tint. The desired whitening effect is produced by dyeing the fabric a different color; the blue and red combine with the yellowish tint of the worn fabric to give the overall fabric a new light grey or bluish grey color which looks whiter and is more pleasing to the eye than the faint yellow coloring of the worn material.

It is desirable to have a method to restore the attractive appearance of a dyed fabric containing para-aramid yarn when such fabric loses its dyed appearance due to fibrillated yarns created from wear, from laundering, or from weaving of the dyed or pigmented fiber.

SUMMARY OF THE INVENTION

The present invention is directed to a process for restoring the appearance of an article of clothing comprising a fabric made from a dyed or pigmented yarn having para-aramid yarn segments with fibrils comprising the steps of:

(a) contacting the article of clothing with an aqueous dye solution or dye dispersion to dye the para-aramid yarn fibrils a color equivalent to the color of the dyed or pigmented yarn, and (b) drying the article of step (a).

In a further embodiment of the invention, the appearance of a para-aramid starting material is improved after the dyed or pigmented fiber is woven into a fabric but prior to making into an article of clothing wherein fibrillation occurs solely due to the weaving process. This appearance improvement involves the same steps (a) and (b) above except the fabric rather than a article of clothing is contacted with the dye solution to dye the fibrils.

The restoring of the color of a garment and the improving the color of a woven fabric is done by dyeing the yarn fibrils without substantially changing the color of the aramid yarns.

DETAILED DESCRIPTION OF THE INVENTION

The starting material in the present invention is typically an article of clothing made from para-aramid yarn wherein the article of clothing has been colored prior to its manufacture, either by dyeing of the fibers, fabrics, or garments, or by pigmentation of the fibers used in the fabrics and garments. Through wear of the clothing, the clothing appearance deteriorates due to abrasion. The appearance can also deteriorate gradually due to repeated laundering, which also wears and abrades the clothing.

Illustratively for fire fighting equipment outer garments, the clothing encounters abrasion through surface contact and becomes dirty through normal wearing including perspiration of the wearer or often due to contact with smoke, soot and extreme cases of corrosive chemicals. Accordingly, such outer garments are washed in conventional washing machines employing household detergents. Moreover, it has been found with para-aramid fibers, repeated washings can cause the clothing to lose its new dyed appearance.

Fibrillation of para-aramid yarn results in the unattractive appearance of the clothing. While soiling of individual fibers also occurs, it is considered that fibrillation is often the predominant reason for the negative appearance.

Illustratively, a reason for the loss of the fresh look of a new fabric is thought to be due to the difference in light reflectance of the fibrillated filaments in the yarns of the fabric. The filaments in each yarn have a certain color and shade due to the dye or pigment concentration in the filament. As the filaments rub against on another in the yarns, or are abraded by surfaces, tiny fibrils form and partially separate from the surface of the filaments. Since the fibrils have a much smaller diameter, it is believed they reflect light differently compared to the main filaments. The fibrillated fabric surface begins to look lighter in shade with portions of fabric of different shades due to the manner light is reflected and is unattractive. Additionally, with a combination of different yarns, such as a non-para-aramid yarn in addition to the para-aramid yarn, the amount of fibrillation is proportional to PPD-T concentration and thus amount will differ. Such difference affects the visual color appearance.

Although it is well known that it is difficult to impart color to para-aramid yarn by dyeing or pigmenting, nevertheless it has been discovered that fibrils of the para-aramid yarn readily absorb a dye. Therefore the present invention is directed to modifying the appearance of the fibrils by dyeing such that their color and reflection of light is similar to that of the unfibrilated yarn segments which accounts for the bulk of the cloth.

The dyeing operation primarily affects the fibrils with little or no effect on the previously colored para-aramid filament.

The present invention allows the wearer to restore the appearance of the article of clothing using a conventional washing machine operating at normal operating conditions. The starting material for the article of clothing is a cloth comprising a dyed or pigmented para-aramid yarn. However, in a typical article of clothing, the content of para-aramid fiber may be small, i.e. as low as 5 percent by weight of the clothing (ignoring any additional clothing liner).

Useful aramids and methods for making these fibers are described in greater detail in U.S. Pat. Nos. 5,336,734 and 5,660,779 to Bowen, et al., U.S. Pat. Nos. 3,767,756 and 3,869,429 to Blades, and U.S. Pat. No. 4,144,023 to Provost.

These fibers are prepared from aromatic polyamides containing divalent aromatic radicals in which the chain extending bonds of the radicals are substantially coaxial or parallel and oppositely directed and are connected by amide (—NHCO—) linkages. The radicals may also be linked by vinylene, ethynylene, azo or azoxy radicals. A portion of the aromatic radicals may be replaced with trans-1,4-cyclohexylene radicals.

The preferred para-aramid fiber is made from PPD-T. By PPD-T is meant the homopolymer resulting from polymerization of paraphenylene diamine and terephthaloyl chloride and, also, copolymers resulting from incorporation of small amounts of other diamines with the paraphenylene diamine and/or small amounts of other diacid chlorides with the terephthaloyl chloride. As a general rule, other diamines and other diacid chlorides can be used in amounts up to as much as about 10 mole percent of the paraphenylene diamine or the terephthaloyl chloride, provided only that the other diamines and diacid chlorides have no reactive groups which interfere with the polymerization reaction. Preparation of PPD-T is described in U.S. Pat. Nos. 3,869,429; 4,308,374; and 4,698,414.

Briefly, these fibers are typically prepared by extruding the polymer through orifices in a spinneret to form individual filaments which are combined to form continuous multifilament yarns. These yarns may be plied or wrapped with other yarns and then knitted or woven into fabrics. Alternatively, if a spun staple fiber yarn is desired, these continuous multifilament yarns can be stretch broken or cut into staple fiber and spun into staple yarns using conventional cotton system processing techniques. The continuous multifilament yarns can also be combined with other types of multifilament yarns to form a tow. The tow is then generally cut to form staple fibers which are later spun into yarns and then into fabrics using known techniques.

The fibers which will ultimately have fibrils to be treated after being made into fabrics using the method of this invention can be in the form of continuous filaments or staple fibers. They are formed into yarns and subsequently into fabrics.

An article of clothing can include a high content of non-para-aramid fibers. In a preferred embodiment the garment contains primarily para-aramid fibers which are made from poly (p-phenylene terephthalamide) (PPD-T) and meta-aramid fibers made from poly (m-phenylene isophthalamide) (MPD-I).

As discussed in the Background of the Invention, a number of techniques are known for dyeing or imparting pigment to aramid fiber. These techniques may be employed to a cloth containing only one type of para-aramid fiber or may be employed upon a cloth containing fibers from one or more aramids or from other synthetic polymers.

In the present invention the article of clothing with the aramid fiber has its appearance restored by use of a dilute aqueous soluble dye or aqueous dye dispersion. As previously mentioned, the color may be imparted to the fabric using a conventional washing machine. Therefore readily available commercial or home consumer washing machines can be employed operating at atmospheric pressure.

The type of dyes which can be suitable in the present invention are varied and include cationic, disperse or acid dyes.

However cationic dyes are preferred in the case where they are readily soluble in water. A dye dispersion is less preferred since for optimum results a dispersion generally needs to be added to water prior to any contact with the article of clothing.

The weight concentration ratio of dye to weight of fabric to be colored can vary over wide ranges. Illustratively, dilute dye concentrations can be employed such as low as 0.01% based on the weight of the fabric. However it is preferred to employ concentrations in a range from 0.02 to 0.1%. An upper concentration is not critical but general will not be more than 1% by weight. Excessive dye concentrations are not desirable since excessive dye will be discarded.

Generally, the dissolution of the dye in water which contains the article of clothing is easily accomplished so the amount of water used is not especially critical. Generally this amount of water is based on a ratio to the weight of fabric. Suitable ratios of water to fabric can range from 3:1 to 100:1 by weight.

A factor which can influence the dyeing of the fibrils is the temperature of the water for the dye solution or dye dispersion. Generally a temperature of at least 40° C. will be employed. An example of a suitable range is from 40 to 80° C. Temperatures in the range of from 55 to 65° C. are preferred. Generally aqueous dye contact with the article of clothing will be at least 5 minutes, generally at least 10 minutes and more preferably 30 minutes. These conditions are very mild and will only result in the dyeing of the para-aramid fibrils and not the para-aramid filaments, which are very hard to dye.

In the process according to the invention it is not necessary to include dye assist agents in the dye solution. By dye assist agents it is meant carriers or additional chemicals that are added to swell the fiber. Furthermore, the use of high pressure to assist in the uptake of the dye from the bath is not necessary and atmospheric conditions are preferred. Also, the use of a fluorescent agent, and particularly a blue fluorescent substance such as disclosed in U.S. Pat. No. 2,424,778 is not necessary and lies outside the scope of the present invention which is directed to restoring appearance of fibrillated fibers. Accordingly such substance lies outside the definition of a dye as employed in the present invention.

In the above disclosure the starting material with an initial unattractive appearance is an article of clothing. However, in an alternate embodiment of the invention the starting material can be a woven cloth containing the aramid yarn i.e., a precursor to an article of clothing which becomes fibrillated solely due to stresses in the wearing. In such case the yarn has been dyed prior to a weaving operation.

Prior to weaving or knitting the individual dyed or pigmented fibers of the yarn have an attractive appearance. However, due to the natural stiffness of the para-aramid yarns and of the friction generated by the processing of those yarns in the weaving operation, some fibrils are created during the weaving of the yarns into fabrics. The generation of these fibrils affects the appearance of the fabric and detracts from the color which could be obtained if the yarns could be processed into fabrics with little of no friction. In this embodiment to improve the appearance of a fabric before it is made into an article of clothing, the same process steps and conditions can be undertaken as described with the article of clothing. However, instead of the clothing the article being treated is the precursor fabric.

To illustrate the present invention, the following examples are provided.

All parts and percentages are by weight unless otherwise indicated. Also all temperatures are in degrees centigrade. The color determinations were made using a Hunter Tristimulus Colorometer model D25M-9.

The color and shade depth for the various samples of fabric were determined by measuring the Hunter 'L', 'a', and 'b' values in the conventional manner. The 'L' color component is a measure of the blackness or whiteness of the sample, with lower numbers indicating darker shades, while the 'a' value is a measure of where the color of the sample is in the red to green range and the 'b' value is a measure of where the color of the sample is in the blue to yellow range.

EXAMPLE 1

A burgundy fabric of sulfonated poly(paraphenylene terephthalamide) (PPD-T) commercially available as Nomex® Z-200 was washed 20 times according to ISO 6330 procedure. In the steps that follow in this example the aqueous dye bath to fabric ratio (wt:wt) was 3:1.

The color determinations are as follows:

| | L | a | b |
|---|---|---|---|
| As Received | 27.8 | 14.5 | 5.2 |
| After 20 Washes | 31.5 | 16.4 | 6.7 |

Visual inspection of the washed fabrics indicated a degree of fibrillation had occurred.

Washed fabric was next over dyed in pad-dyeing nip equipment with 0.1% (weight of dye/weight of fabric) Viocryl red AGL 300% (Basic Red 29) at 60 degrees C. for 30 min. at pH 4.0 using acetic acid to adjust pH. Fibrils absorbed the single dyestuff but the color was not exactly the same as the background shade since the color determination was as follows:

| | L | a | b |
|---|---|---|---|
| Washed and overdyed | 30.5 | 17.5 | 6.9 |

The washed and dyed fabric was next overdyed with different pH levels and modified dye recipe and concentrations aimed at visually matching the unwashed fabric shade more closely:

| Recipe: | |
|---|---|
| A. | Viocryl Yellow AGL 200% (Basic Yellow 28) @ 0.018% |
| B. | Viocryl red AGL 300% (Basic Red 29) @ 0.024% |
| C. | Viocryl blue ARL 300% (Basic Blue 41) @ 0.005% |

(Percents are weight of dye to weight of fabric.)

Different pH levels were used as follows: the pH level of the dye bath was adjusted with acetic acid to pH6; the pH level of the dye bath was adjusted with sodium carbonate to pH7, pH8 and pH9. All fibril dyeings were successful at all pH levels and the bath was exhausted completely at 60 degrees C. and 30 minutes run time.

| | L | a | b |
|---|---|---|---|
| pH 6 | 30.0 | 15.8 | 6.7 |
| pH 7 | 30.3 | 15.9 | 6.1 |
| pH 8 | 30.3 | 16.1 | 6.0 |
| pH 9 | 29.8 | 15.9 | 6.8 |
| original | 27.8 | 14.5 | 5.2 |

This example demonstrates that the initial dyeing procedure results in a fabric with a pleasing appearance. However for the fabric to result in a shade which more closely matches the initial color of the unwashed fabric, care was required in the composition of the dye bath formulation.

EXAMPLE 2

A Navy Blue fabric of sulfonated poly(paraphenylene terephthalamide) (PPD-T) commercially available as Nomex® Z-200 was washed 20 times according to ISO6330 and then contacted with 0.5% navy blue dye Basic Blue 41 (weight of dye/weight of fabric) at 60 degrees C. for 30 minutes. The aqueous dye bath to fabric ratio (wt:wt) was 10:1.

The fabric was then dried 120° C. for 30 minutes.

| | L | a | b |
|---|---|---|---|
| Original Fabric | 23.4 | 1.6 | −8.0 |
| 20 Washes | 24.2 | 6.3 | −8.5 |
| Washed, renewed fabric | 22.5 | 2.9 | −9.2 |

The visual appearance of the fabric after washing 20 times resulted in a faded unattractive blue with a degree of fibrillation occurring. However after dye contact the fabric had a new, pleasing blue appearance.

EXAMPLE 3

A 60/40 staple blend of black poly(paraphenylene terephthalamide) (PPD-T) and black poly(metaphenylene isophthalamide) (MPD-I) fibers were converted to fabric by normal staple spinning and fabric weaving. Simple action of staple spinning and fabric weaving caused a sufficient amount of fibrillation so that fabric was unusable as a garment candidate.

The fabric was dyed at 60 degrees C. for 30 minute using 0.2% Burocryl Black R cationic dye (weight of dye/weight of fabric). This small amount of dye was sufficient to deepen the color of the fibrils to bring fabric shade back to a visually acceptable level. The liquor to fabric ratio (wt:wt) was 10:1.

The Hunter Color Values below demonstrate shade changes.

| | L | a | b |
|---|---|---|---|
| Staple Blend | 18.7 | 0.4 | 0.9 |
| Woven fabric | 22.9 | −1.3 | −0.8 |
| Renewed fabric | 21.6 | −0.3 | −2.2 |

What is claimed is:

1. A process for restoring the appearance of an article of clothing comprising a fabric made from pigmented or dyed yarns having para-aramid yarn segments with fibrils comprising the steps of:

(a) contacting the article of clothing with an aqueous dye solution or dye dispersion to dye the para-aramid fibrils a color equivalent to the color of the dyed or pigmented yarn utilizing a washing machine employing a temperature of 40° C. to 80° C., and (b) drying the article of step (a).

2. The process of claim 1 wherein the clothing comprises a para-aramid content of at least 5 percent by weight.

3. The process of claim 2 wherein the para-aramid is poly(paraphenylene terephthalamide).

4. The process of claim 3 wherein the fabric includes poly(m-phenylene isophthalamide).

5. The process of claim 1 wherein the aqueous dye solution or dispersion does not employee a dye assist agent.

6. The process of claim 1 wherein an aqueous dye solution is employed.

7. The process of claim 1 wherein the initial dye concentration is at least 0.01% by weight based on the weight of the article of clothing.

8. The process of claim 1 wherein the dye is a cationic dye.

9. The process of claim 1 wherein the article of clothing is outer garment fire fighting clothing.

10. A process for improving the appearance of an article comprising a fabric made from a pigmented or dyed aramid yarn having para-aramid yarn segments with fibrils comprising the steps of:

(a) contacting the article with an aqueous dye solution or dye dispersion to dye the para-aramid fibrils utilizing a washing machine employing a temperature of 40° C. to 80° C., and (b) drying the article of step (a).

11. The process of claim 10 wherein the fibrils are dyed to a color equivalent to the pigmented or dyed aramid yarn filaments.

* * * * *